United States Patent [19]

Wyse

[11] Patent Number: 4,577,363

[45] Date of Patent: Mar. 25, 1986

[54] SCRAPER RING FOR CLEANING A HYDRAULIC CYLINDER ROD OR SHAFT

[76] Inventor: Harold G. Wyse, 3629 N. Dixie Dr., P.O. Box 1431, Dayton, Ohio 45414

[21] Appl. No.: 707,099

[22] Filed: Mar. 1, 1985

[51] Int. Cl.[4] ..... B08B 13/00

[52] U.S. Cl. ..... 15/256.5; 15/104.04; 15/236 R

[58] Field of Search ..... 15/104.04, 236 R, 256.5; 277/24; 166/176

[56] References Cited

U.S. PATENT DOCUMENTS

| | | | |
|---|---|---|---|
| 1,822,521 | 9/1931 | Fox et al. | 15/256.5 |
| 2,443,853 | 6/1948 | Fall | 15/256.5 |
| 2,772,105 | 11/1956 | Wyse | 15/236 R |
| 2,884,654 | 5/1959 | Fall | 15/256.6 X |
| 3,999,240 | 12/1976 | Uchida | 15/104.04 X |

*Primary Examiner*—Edward L. Roberts

*Attorney, Agent, or Firm*—Jacox & Meckstroth

[57] ABSTRACT

Foreign material is removed from a shaft or rod of a hydraulic cylinder by a surrounding wiper or scraper ring formed in two semicircular mating sections. The sections have surfaces forming a shaft engaging scraping edge and also have axially spaced walls which define a circumferentially extending external groove. The ring sections are mounted on the rod or shaft and are coupled together or retained by a resilient spring wire having undulations which extend within the radial groove. Closely spaced opposite end portions of the retaining wire are curled to form eyelets and project laterally from the groove into an undercut recess which intersects the groove. The eyelets are adapted to receive the tips of a tool for releasably positioning the end portions of the retaining wire within the undercut recess.

14 Claims, 5 Drawing Figures

SCRAPER RING FOR CLEANING A HYDRAULIC CYLINDER ROD OR SHAFT

BACKGROUND OF THE INVENTION

The present invention is directed to a wiper or scraper ring of the general type disclosed in U.S. Pat. No, 2,772,105 which issued to applicant and discloses a metal ring for scraping and cleaning the cylindrical surface of an axially movable rod or shaft. For example, such a scraper ring is used for cleaning the piston rod of a hydraulic cylinder used for operating aircraft landing gear and for cleaning other rods and shafts which are exposed to dirt, mud, ice and other foreign material. The wiper or scraper ring scrapes and cleans the shaft or rod during axial movement to prevent the foreign material from entering the shaft support bearings or the hydraulic packing glands or seals. The wiper or scraper ring of the type disclosed in the above-mentioned patent is installed on the rod during assembly of the hydraulic cylinder and is slid axially over the end of the rod before the rod is connected to an end fitting such as an aircraft landing gear or component of an injection molding press.

Occasionally, it is necessary to replace a scraper ring after it has had an extended period of service and it is desirable to provide for replacing the scraper ring without disassembling the fitting or component mounted on or connected to the end of the rod. Such replacement significantly reduces the down time of the equipment which utilizes the scraper ring and thus substantially reduces the cost of replacing the scraper ring.

SUMMARY OF THE INVENTION

The present invention is directed to an improved wiper or scraper ring for mounting on an axially movable cylindrical rod or shaft and which is effective to remove foreign material collected on the shaft in order to obtain maximum service life of either the bearings supporting the shaft and/or the fluid sealing rings or packing glands which contact the shaft. The scraper ring of the invention is constructed to be mounted or installed on the shaft without disassembling the end fitting or component connected to the shaft and is adapted to be quickly assembled onto the shaft or removed from the shaft when it is desired to replace the scraper ring after an extended period of use.

In general, the above features are provided by a scraper ring which is constructed, according to one embodiment, in two semicircular ring sections which have surfaces cooperating to form a sharp scraping edge for engaging the outer cylindrical surface of the rod or shaft. The ring sections define a peripherally extending external groove which receives a flexible spring retaining wire having a thickness slightly less than the width of the groove. The retaining wire has undulations along its length to provide a predetermined resiliency, and opposite end portions of the retaining wire are formed into loops or eyelets and project laterally into an undercut recess interrupting the groove. The end portions of the retaining wire are adapted to receive the pointed tips of pliers-type tool to provide for quickly assembling the ring sections onto a rod or shaft and for removing the ring sections when it is desired to replace the scraper ring.

Other features and advantages of the invention will be apparent from the following description, the accompanying drawing and the appended claims.

DESCRIPTION OF THE PREFERRED EMBODIMENT

Figure 1:
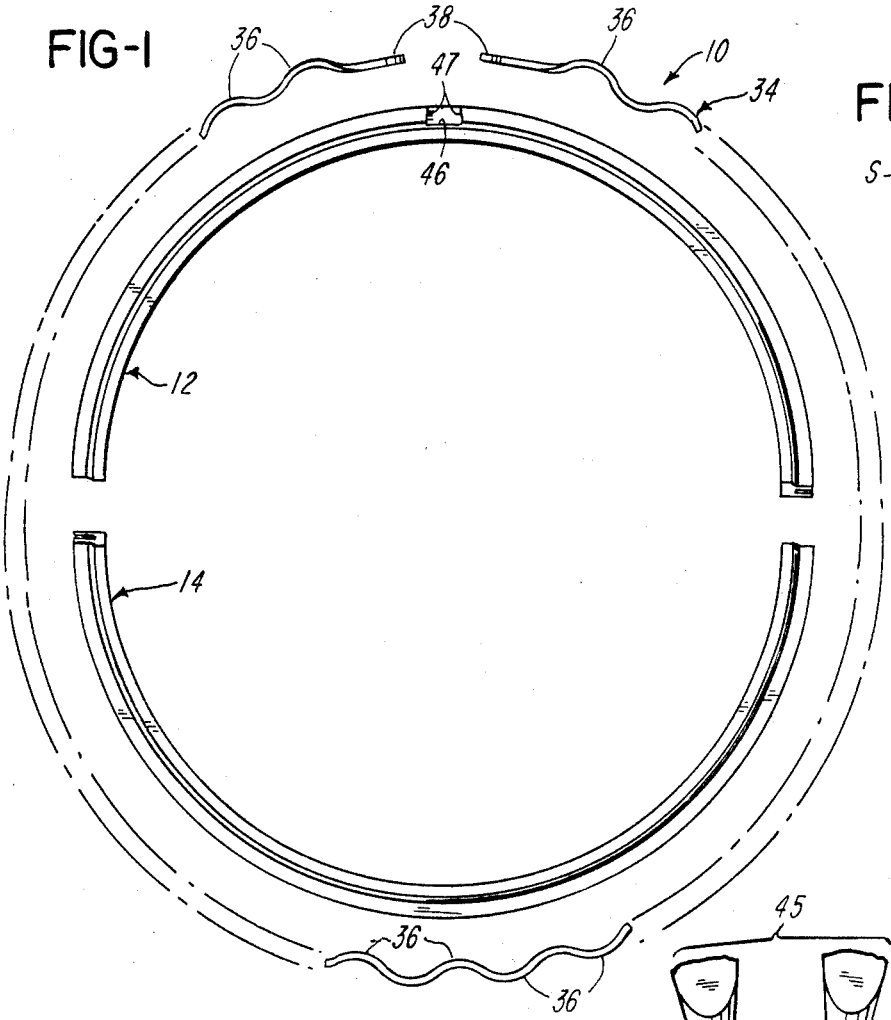
FIG. 1 is an exploded perspective view of a scraper ring constructed in accordance with the invention.
Figure 2:
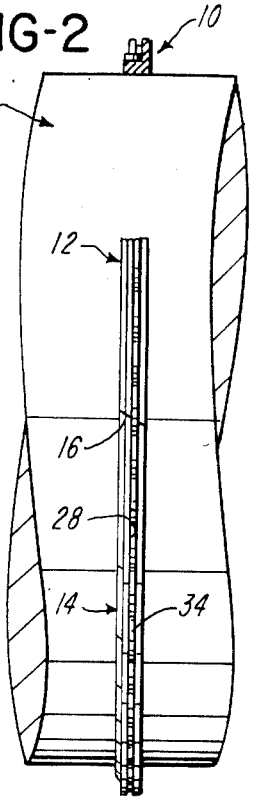
FIG. 2 is a part elevation and part section view of the scraper ring shown in FIG. 1 and shown assembled onto a shaft.
Figure 3:
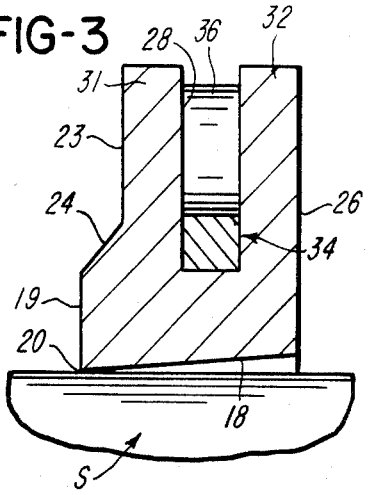
FIG. 3 is an enlarged cross-section of the assembled scraper ring.

FIG. 1 illustrates a wiper or scraper ring assembly 10 which is constructed in accordance with the invention and which is generally similar in cross-section to the scraper or wiper ring illustrated in U.S. Pat. No. 2,772,105, the disclosure of which is incorporated herein by reference. The ring assembly 10 includes a pair of mating semi-circular sections 12 and 14, the ends of which are beveled and opposing to form diametrically opposed splits 16. The cross-sectional configuration of each ring section 12 and 14 is identical and is shown in FIG. 3. Each section includes a beveled or tapered inner surface 18 which cooperates with a radial end surface 19 to form a sharp scraping edge 20. The edge 20 engages the outer cylindrical surface of a rod or shaft S which is supported for axial movement within the ring assembly 10, as described in the above-mentioned patent.

Each of the ring sections 12 and 14 has a forward radial surface 23 which is connected to the forward radial surface 19 by a tapered or frusto-conical surface 24. Each ring section also has an opposite end surface 26, and a peripherally extending groove 28 is formed within each ring section. The width of the circumferentially extending groove 28 is approximately the same as the thickness of the forward wall 31 and the rearward wall 32 which define the groove 28.

The scraper ring assembly 10 also includes a retaining element in the form of a spring wire 34 which has a rectangular cross-sectional configuration, as shown in FIG. 3. The retaining wire 34 also has a a series of undulations 36 along its length which provide the wire with the serpentine-like configuration. The width of the retaining wire 34 is slightly less than the width of the groove 28, and the inner surfaces of the undulations 36 seat on the inner cylindrical surface of the groove 28. The retaining element or wire 34 has opposite end portions 38 which are formed or curled to form a pair of holes or eyelets 39 for receiving the cylindrical tips 43 of a pliers-like tool 45. The forward wall 31 of the ring seciton 12 is provided with a notch or recess 46 which is defined by opposing sloping surfaces 47 so that the recess is undercut on opposite ends.

Figure 4:
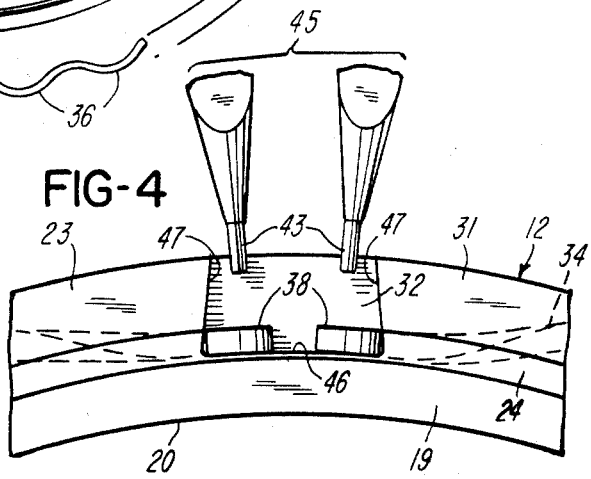
FIG. 4 is an enlarged fragmentary axial view of an assembled scraper ring and illustrating the type of tool used for assembling and disassembling the ring.
Figure 5:
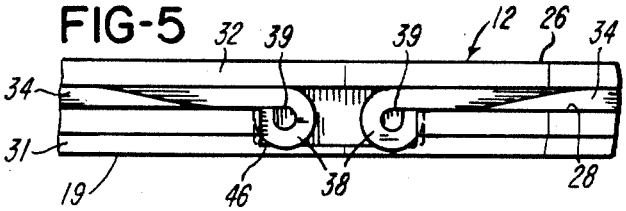
FIG. 5 is an enlarged radial view of the ring section shown in FIG. 4.

In the installation of the scraper ring assembly onto a cylindrical shaft S, the retaining wire 34 is inserted into the groove 28 of the ring section 14, and these components are placed into engagement with a semi-cylindrical portion of the shaft S. The ring section 12 is then placed on the shaft S in alignment with the ring section 14, and the opposite end portions 38 of the retaining wire 34 are brought together so that the wire 34 moves into the groove 28 within the ring section 12. The tips 43 of the pliers-like tool 45 are then inserted into the eyelets 39, and the end portions 38 of the wire 34 are drawn together and inserted into the undercut recess 46, as shown in FIGS. 4 & 5.

The tension force within the resilient retaining wire 34 after the end portions 38 are inserted into the recess 46, causes the inner surfaces of the undulations 36 to press the ring sections 12 and 14 radially inwardly against the shaft S with a substantially uniform force around the entire circumference of the shaft. Thus the retaining element or spring wire 34 within the groove 28 functions not only to maintain precise alignment of the ring sections 12 and 14 but also to maintain a radially inwardly resilient force against the ring sections 12 and 14 around the ring assembly 10. This inward radial force against the ring sections 12 and 14 assures that the scraping edge 20 remains in uniform pressure contact with the cylindrical surface of the shafts in order to provide effective cleaning of the shaft as it moves axially within the ring assembly. While the ring sections 12 and 14 are shown in metal such as brass or bronze, the sections may also be formed or molded of a rigid high strength plastics material.

From the drawing and the above description, it is apparent that a scraper ring assembly constructed in accordance with the present invention, provides desirable features and advantages. As a primary advantage, the ring assembly 10 may be installed on a hydraulic piston rod or shaft S without any disassembly of the fitting or component mounted on an end of the rod or shaft. Thus the ring assembly 10 may be quickly and easily replaced in the event that the sharp scraping edge 20 becomes dull after an extended period of use. As another important feature, the corregated shape of the metal retaining wire 34 provides for a uniform inwardly directed resilient force completely around the ring sections 12 and 14 so that the scraping edge 20 receives uniform wear and provides maximum service life. In addition, the undercut recess 46 within the forward side wall 31 of the ring section 12 provides for a simplified and positive means for retaining the rolled opposite end portions 38 of the retaining wire 34 and further provides for convenient access to the eyelets with the tool 45 in order to position the end portions 39 into the recess 46 during installation and for removing the end portions from the recess during removal of the ring assembly for replacement.

While the form of scraper ring herein described constitutes a preferred embodiment of the invention, it is to be understood that the invention is not limited to this precise form of scraper ring, and that changes may be made therein without departing from the scope and spirit of the invention as defined in the appended claims.

The invention having thus been described, the following is claimed:

1. An improved scraper ring adapted to be mounted on a movable cylindrical shaft for scraping and cleaning the shaft, comprising a set of separate and mating part-circular ring sections fitted together to form an annular body, said body including a circumferentially extending inner surface and a side surface cooperating to form a scraping edge for cleaning foreign material from the outer cylindrical surface of the shaft, said ring sections defining an external groove extending circumferentially around said body, a resilient retaining means extending circumferentially within said groove and having opposite end portions, and means for connecting said opposite end portions of said retaining means to one of said ring sections.

2. A scraper ring as defined in claim 1 wherein said retaining means comprises a spring wire having serpentine-like undulations disposed in a radial plane, and said groove has a radial depth at least as great as the radial depth of said undulations.

3. A scraper ring as defined in claim 2 wherein said spring wire has a rectangular cross-sectional configuration.

4. A scraper ring as defined in claim 1 wherein said retaining means comprises a spring wire including formed opposite end portions having a width greater than the width of said groove, and means defining a recess within one of said ring sections and intersecting said groove for receiving said end portions of said spring wire.

5. A scraper ring as defined in claim 4 wherein said opposite end portions of said spring wire defined openings for receiving a tool adapted to draw said end portions together and to position said end portion within said recess.

6. A scraper ring as defined in claim 4 wherein said spring wire has a rectangular cross-sectional configuration, and the width of said groove is slightly greater than the width of said spring wire.

7. A scraper ring as defined in claim 4 wherein said spring wire has serpentine-like undulations along the length of said wire, and said undulations are disposed in the radial plane of said groove.

8. A scraper ring as defined in claim 1 wherein said circumferentially extending groove is defined by axially spaced walls, and means defining a recess within one of said walls and interrupting said groove for receiving said end portions of said retaining means.

9. A scraper ring as defined in claim 8 wherein said recess is undercut for securing said opposite end portions of said retaining means.

10. A scraper ring as defined in claim 1 wherein said annular body comprises two semi-circular said ring sections, said retaining means comprise a flexible spring wire substantially surrounding both of said ring sections and having closely spaced opposite end portions, and means defining an interruption within said groove for receiving said end portions of said spring wire.

11. An improved scraper ring adapted to be mounted on a movable cylindrical shaft for scraping and cleaning the shaft, comprising a set of separate and mating semi-circular ring sections fitted together to form an annular body, said body including a circumferentially extending inner surface and a side surface cooperating to form a scraping edge for cleaning foreign material from the outer cylindrical surface of the shaft, said ring sections defining an external groove extending circumferentially around said body, an elongated spring wire retaining element extending circumferentially within said groove and having closely spaced opposite end portions, said retaining element having serpentine-like undulations along the length of said wire, and means defining a recess within one of said ring sections and interrupting said groove for receiving and releasably retaining said opposite end portions of said retaining element.

12. A scraper ring as defined in claim 11 wherein said opposite end portions of said spring wire are curved to define openings for receiving a tool adapted to draw said end portions together and to position said end portions within said recess.

13. A scraper ring as defined in claim 11 wherein said spring wire has a rectangular cross-sectional configuration, and the width of said groove is slightly greater than the width of said spring wire.

14. A scraper ring as defined in claim 11 wherein said recess is undercut on opposite ends for positive securing said opposite end portions of said retaining element.

* * * * *